US006019576A

United States Patent [19]

Thut

[11] Patent Number: 6,019,576

[45] Date of Patent: Feb. 1, 2000

[54] PUMPS FOR PUMPING MOLTEN METAL WITH A STIRRING ACTION

[76] Inventor: Bruno H. Thut, 16755 Park Circle Dr., Chagrin Falls, Ohio 44023-4598

[21] Appl. No.: 08/935,493

[22] Filed: Sep. 22, 1997

[51] Int. Cl.[7] ..... F04D 7/06

[52] U.S. Cl. ..... 415/200; 416/185; 416/241 B

[58] Field of Search ..... 415/1, 200, 206; 416/181, 182, 179, 185, 241 B, 223 B

[56] References Cited

U.S. PATENT DOCUMENTS

| | | |
|---|---|---|
| 485,906 | 11/1892 | Brown . |
| 761,730 | 6/1904 | Tucker . |
| 1,037,659 | 9/1912 | Rembert . |
| 1,196,758 | 9/1916 | Blair . |
| 1,988,875 | 1/1935 | Saborio . |
| 2,054,923 | 9/1936 | Betterton et al. . |
| 2,072,650 | 3/1937 | Schmeller, Sr. . |
| 2,173,377 | 3/1934 | Schutz . |
| 2,273,214 | 2/1942 | McConaghy . |
| 2,294,135 | 8/1942 | Smith . |
| 2,300,688 | 3/1941 | Nagle . |
| 2,304,849 | 5/1940 | Ruthman . |
| 2,368,962 | 2/1945 | Blom . |
| 2,383,424 | 8/1945 | Stepanoff . |
| 2,464,936 | 3/1949 | McConaghy . |
| 2,493,467 | 1/1950 | Sunnen . |
| 2,528,208 | 10/1950 | Bonsack et al. . |
| 2,528,210 | 10/1950 | Stewart . |
| 2,626,086 | 1/1953 | Forrest . |
| 2,714,354 | 8/1955 | Farrand . |
| 2,775,348 | 12/1956 | Williams . |
| 2,779,574 | 1/1957 | Schneider . |
| 2,808,782 | 10/1957 | Thompson et al. . |
| 2,824,520 | 2/1958 | Bartels . |
| 2,918,876 | 12/1959 | Howe . |
| 2,948,524 | 8/1960 | Sweeney et al. . |
| 2,978,885 | 4/1961 | Davison . |
| 3,048,384 | 8/1962 | Sweeney et al. . |
| 3,070,393 | 12/1962 | Silverberg et al. . |
| 3,092,030 | 6/1963 | Wunder . |
| 3,227,547 | 1/1966 | Szekely . |

(List continued on next page.)

FOREIGN PATENT DOCUMENTS

| | | |
|---|---|---|
| 0661851 | 4/1963 | Canada . |
| 1264126 | 1/1990 | Canada . |
| 2097648 | 12/1993 | Canada . |
| 0586800 | 9/1997 | European Pat. Off. . |
| 620831 | 4/1927 | France . |
| 1024602 | 4/1953 | France . |
| 1382504 | 11/1964 | France . |
| 2376310 | 12/1977 | France . |
| 804064 | 4/1951 | Germany . |
| 808796 | 7/1951 | Germany . |
| 954669 | 12/1956 | Germany . |
| 3614044 | 11/1987 | Germany . |
| 3-164594 | 7/1991 | Japan . |
| 5-117771 | 5/1993 | Japan . |
| 5-117772 | 5/1993 | Japan . |
| 261718 | 1/1949 | Switzerland . |
| 30059 | of 1914 | United Kingdom . |
| 0365991 | 1/1932 | United Kingdom . |
| 0715923 | 9/1954 | United Kingdom . |

OTHER PUBLICATIONS 1 page advertising brochure, New L–Series Pumps, Metaullics Systems Co., L.P., undated.

29 page operating instruction booklet, H.T.S. Pump Equation for the Eighties, High Temperature Systems, Inc., undated.

(List continued on next page.)

*Primary Examiner*—Edward K. Look
*Assistant Examiner*—Richard Woo
*Attorney, Agent, or Firm*—Watts, Hoffmann, Fisher & Heinke Co., LPA

[57] ABSTRACT

A non-metallic pump for pumping molten metal includes a motor, a shaft having one end connected to the motor and an impeller connected to the other end of the shaft. A base has a chamber in which the impeller is rotatable. Structure is used to removably insert the base into a bath of molten metal. The impeller includes stirrer openings which are configured and arranged to enable the impeller to cause solid matter in the molten metal to move toward an upper surface of the bath.

51 Claims, 4 Drawing Sheets

U.S. PATENT DOCUMENTS 3,255,702 6/1966 Gehrm .
3,276,758 10/1966 Baker et al. .
3,291,473 12/1966 Sweeney et al. .
3,459,133 8/1969 Scheffler .
3,532,445 10/1970 Scheffler, Jr. et al. .
3,573,895 4/1971 Ostberg .
3,575,525 4/1971 Fox et al. .
3,608,621 9/1971 Bollig et al. .
3,650,513 3/1972 Werner .
3,650,516 3/1972 Mantell et al. .
3,690,621 9/1972 Tanaka et al. .
3,719,436 3/1973 McFarlin .
3,759,635 9/1973 Carter et al. .
3,767,382 10/1973 Bruno et al. .
3,776,660 12/1973 Anderson et al. .
3,791,813 2/1974 Ramachandran et al. .
3,792,848 2/1974 Ostberg .
3,801,003 4/1974 Racunas et al. .
3,814,396 6/1974 De Gregorio et al. .
3,836,280 9/1974 Koch .
3,839,019 10/1974 Bruno et al. .
3,861,660 1/1975 Ammann et al. .
3,862,839 1/1975 Shimizu et al. .
3,870,511 3/1975 Szekely .
3,871,872 3/1975 Downing et al. .
3,873,305 3/1975 Claxton et al. .
3,887,172 6/1975 Funck et al. .
3,921,473 12/1966 Sweeney .
3,953,552 4/1976 Strauss .
3,955,970 5/1976 Claxton et al. .
3,982,913 9/1976 Feichtinger .
3,984,234 10/1976 Claxton et al. .
3,997,336 12/1976 van Linden et al. .
4,047,938 9/1977 Szekely .
4,052,199 10/1977 Mangalick .
4,059,251 11/1977 Huzyak .
4,088,502 5/1978 La Bar .
4,116,659 9/1978 Matesa et al. .
4,128,415 12/1978 van Linden et al. .
4,169,584 10/1979 Mangalick .
4,188,287 2/1980 Faulkner et al. .
4,283,357 8/1981 Sidery .
4,287,137 9/1981 Sonoyama et al. .
4,297,214 10/1981 Guarnaschelli .
4,322,245 3/1982 Claxton .
4,351,514 9/1982 Koch .
4,410,299 10/1983 Shimoyama .
4,425,232 1/1984 Lawrence et al. .
4,426,068 1/1984 Gimond et al. .
4,454,078 6/1984 Engelbrecht et al. .
4,470,846 9/1984 Dube .
4,486,228 12/1984 Ormesher .
4,491,474 1/1985 Ormesher .
4,518,424 5/1985 Ormesher .
4,592,658 6/1986 Claxton .
4,598,899 7/1986 Cooper .
4,607,959 8/1986 Miyazaki et al. .
4,664,592 5/1987 Grzina .
4,673,434 6/1987 Withers et al. .
4,717,540 1/1988 McRae et al. .
4,747,583 5/1988 Gordon et al. .
4,786,230 11/1988 Thut ..... 415/200
4,842,227 6/1989 Harrington et al. .
4,898,367 2/1990 Cooper .
4,930,986 6/1990 Cooper .
4,940,384 7/1990 Amra et al. .
4,954,167 9/1990 Cooper .
4,960,163 10/1990 Fang et al. .
5,025,198 6/1991 Mordue et al. .
5,028,211 7/1991 Mordue et al. .
5,058,865 10/1991 Robertson et al. .
5,078,572 1/1992 Amra et al. .
5,088,893 2/1992 Gilbert et al. .
5,092,821 3/1992 Gilbert et al. .
5,098,134 3/1992 Monckton .
5,119,977 6/1992 Moschini .
5,131,632 7/1992 Olson .
5,143,357 9/1992 Gilbert et al. .
5,160,693 11/1992 Eckert et al. .
5,165,858 11/1992 Gilbert et al. .
5,177,035 1/1993 Gee et al. .
5,181,828 1/1993 Gilbert et al. .
5,192,193 3/1993 Cooper et al. .
5,203,681 4/1993 Cooper .
5,213,468 5/1993 Sexton et al. .
5,268,020 12/1993 Claxton .
5,294,245 3/1994 Gilbert et al. .
5,308,045 5/1994 Cooper .
5,310,412 5/1994 Gilbert et al. .
5,330,328 7/1994 Cooper .
5,364,450 11/1994 Eckert .
5,366,207 11/1994 Lin .
5,421,562 6/1995 Vander Jagt .
5,435,960 7/1995 Bressler et al. .
5,462,580 10/1995 Eckert .
5,462,581 10/1995 Eckert .
5,470,201 11/1995 Gilbert et al. .
5,558,505 9/1996 Mordue et al. .
5,586,863 12/1996 Gilbert et al. .
5,587,289 12/1996 Thut .
5,597,289 1/1997 Thut ..... 415/200
5,634,770 6/1997 Gilbert et al. .
5,685,701 11/1997 Chandler et al. .
5,785,494 7/1998 Vild et al. ..... 415/200
5,842,832 12/1998 Thut ..... 415/200

OTHER PUBLICATIONS

Pg. 330–340 (Chpt. 11) from Physics, Worth Publishers, Inc., copyright 1982.

1 pg. advertisement for L–35GI Gas Injection Pump, by Metaullics Systems Co., copyright 1993, 1996.

–One pg. advertisement for M–Series Aluminum Molten Metal Pumps by Metaullics Systems Co., undated.

One pg. schematic drawing of a Molten Metal Pump, source unknown, undated.

6 pg. brochure for "M–Series" molten metal pumps by Metaullics Systems Co., copyright 1984.

16 pg. operating instruction booklet for Metaullics Transfer Pumps for Molten Metal by the Carborundum Co., copyright 1980.

16 pg. operating instruction booklet for Metaullics De–Gas/de–Mag Systems for Aluminum, Metaullics Systems Co., dated Apr. 1, 1985.

16 pg. operating instruction booklet for Metaullics Transfer Pump Systems for Molten Metals, Metaullics Systems Co., copyright 1984.

4 pg. folder listing models of molten metal pumps by High Temperature Systems, Inc., published at least as early as Jun., 1990.

1 pg. advertisement for replacement parts for M9000CSD Gas Injection Pump, High Temperature Systems, Inc., published at least as early as Oct., 1986.

1 pg. advertisement for replacement parts for A5000C and A9000C Molten Metal Pump, High Temperature Systems, published at least as early as Sep., 1977.

1 pg. advertisement for replacement parts for M5000CSD Gas Injection Pump, High Temperature Systems, published at least as early as Oct., 1986.
1 pg. advertisement for replacement parts for M5000C Molten Metal Pump, High Temperature Systems, Inc., dated Jul., 1986.
4 pg. installation booklet for Mark II Molten Metal Pumps, High Temperature Systems, Inc., published at least as early as Sep., 1973.
14 pg. operating instruction booklet for Metaullics Circulation System for Aluminum, Metaullics Systems Co., copyright 1984.
2 pg. advertisement describing exhibit, High Temperature Systems, Inc., 1995. TMS Annual Meeting Exhibition.
5 pg. article for Reduced Fuel Consumption through . . . Mechanized Molten Metal Circulation, The Carborundum Co., published by The Society of Die Casting Engineers, vol. 17, No. 5, pp. 22–31, Sep.–Oct., 1973.
"Fluid Mechanics", Frank M. White, Second Edition, pp. 633–642, copyright 1986.
2 pg. article "Tecumseh Metal Products Moves Aluminum from Furnace . . . ", reprinted from Light Metal Age, date unknown.
14 pg. brochure, Metaullics Circulation Systems for Aluminum, Metaullics Systems, copyright 1984.
2 pg. article, "Furnace Modifications Improve Melt Rate, Fuel Efficiency", from Die Casting Engineer, Jul.–Aug. 1979.
S. Lazarkiewicz, A. Troskolanski, "Impeller Pumps", copyright 1965.
A. Stepanoff, "Pumps and Blowers", copyright 1965.
C. Pfleiderer, "Die Kreiselpumpen", 1961.
Water Engineering & Management, vol. 134, No. 8, (1987).
Brochure by Hayward Gordon, "Cantilevers," 1984.
F. Kristal, F. Annett, "Pumps," 1953.
2 pg. article, "Furnace Modifications Improve Melt Rate, Fuel Efficiency", from Die Casting Engineer, Jul.–Aug. 1979.
T. Hicks, T. Edwards, "Pump Application Engienering" copyright 1971.
H. Addison, "Centrifugal and Other Rotodynamic Pumps," 1966.

PUMPS FOR PUMPING MOLTEN METAL WITH A STIRRING ACTION

FIELD OF THE INVENTION

This invention relates to pumps for pumping molten metal and, in particular, to impellers used in such pumps.

BACKGROUND OF THE INVENTION

Pumps used for pumping molten metal typically include a motor carried by a motor mount, a shaft connected to the motor at one end, and an impeller connected to the other end of the shaft. Such pumps may also include a base with an impeller chamber, the impeller being rotatable in the impeller chamber. Support members extend between the motor mount and the base and may include a shaft sleeve surrounding the shaft, support posts, and a tubular riser. A volute member may be employed in the impeller chamber. Pumps are designed with shaft bearings, impeller bearings and with bearings in the base that surround these bearings to avoid damage of the shaft and impeller due to contact with the shaft sleeve or base. The shaft, impeller, and support members for such pumps are immersed in molten metals such as aluminum, magnesium, copper, iron and alloys thereof. The pump components that contact the molten metal are composed of a refractory material, for example, graphite or silicon carbide.

Pumps commonly used to pump molten metal may be a transfer pump having a top discharge or a circulation pump having a bottom discharge, as disclosed in the publication "H.T.S. Pump Equation for the Eighties" by High Temperature Systems, Inc., which is incorporated herein by reference in its entirety.

A problem that such pumps encounter is that they may be damaged by solid impurities contained in the molten metal including chunks of refractory brick and aluminum oxides. If a piece of hard refractory material becomes jammed in the impeller chamber it may destroy the impeller or shaft, and result in the expense of replacing these components. Chunks of refractory material such as brick with a higher specific gravity than the metal are disposed at the bottom of the vessel. Aluminum oxides with a lower specific gravity than the molten metal rise to the surface of the bath. Refractory material that has a specific gravity approximating that of the molten metal may be suspended in the bath. Refractory impurities in the molten metal are also a problem since, if not removed, they result in poor castings of the metal and potentially defective parts.

Removing impurities from the molten metal bath is a hazardous process. A long steel paddle with an end that is in the shape of a perforated spoon is used to remove the impurities. To remove impurities with the paddle, workers need to come close to the molten metal at an area where temperatures may exceed 120 degrees Celsius. Although workers wear protective gear they may be injured by splatters of metal. At the least, workers face a difficult task in removing the impurities, which they carry out in a two step process- spooning the material upward from the bottom of the vessel and skimming the material from the surface. Each step typically lasts about 10–15 minutes. Removing the material from the bottom is carried out at least once a day and skimming is carried out at least once every eight hours. Removing impurities from the molten metal is a hazardous, costly, but necessary, process using current pumps.

SUMMARY OF THE INVENTION

The present invention is directed to pumps for pumping molten metal with impellers that impart a stirring action which facilitates removing impurities from the bath. The invention utilizes stirrer openings in the impellers which exert either suction or pushing forces on molten metal below the base. The stirring action of the impeller may cause impurities in the molten metal, especially those suspended on or near the bottom, to move toward the upper surface of the bath for removal.

In general, the present invention is directed to non-metallic pumps for pumping molten metal including a motor and a shaft having one end connected to the motor. An impeller is connected to the other end of the shaft which extends along a longitudinal axis, the impeller being constructed in accordance with the present invention. A base has a chamber in which the impeller is rotatable. In particular, the pump base includes an opening in a lower surface thereof and the impeller base is disposed in the pump base opening, i.e., the impeller is used in a top feed pump. Structure is used for removably inserting the base into a bath of molten metal.

One embodiment of the present invention is directed to an impeller made of a non-metallic, heat resistant material. The impeller comprises a base having a generally circular portion. Vanes extend outwardly from a central location of the base portion. Stirrer openings in the base portion are configured and arranged to enable the impeller to cause solid matter in the molten metal to move toward an upper surface of the bath. Each of the stirrer openings in the base portion preferably extends at an angle with respect to the longitudinal axis of the shaft.

More specifically, the impeller base comprises first and second opposing faces and each of the stirrer openings communicates with both of the opposing faces. The stirrer openings are preferably forward pitched relative to a direction of rotation of the impeller. The impeller may comprise a hub portion located centrally on the impeller base and the vanes extend outwardly, preferably tangentially, from the hub portion. Each of the vanes has two side surfaces extending generally in a first longitudinal direction of the rotational axis of the impeller and in a second outward direction from the central location of the base. A side surface of each of the vanes is spaced apart from a side surface of an adjacent vane entirely along the first and second directions. In preferred form, the impeller has five vanes constructed and arranged to dynamically balance the impeller. A bearing may be connected to the impeller base.

Another embodiment of the present invention is directed to what is referred to as a squirrel-cage impeller made of a non-metallic, heat resistant material comprising an opening at a first end portion leading to a central cup-shaped interior. Main openings extend outwardly from the cup-shaped interior. A second end portion is spaced from the first end portion along an axis of rotation of the impeller. Stirrer openings in the second end portion are configured and arranged to enable the impeller when immersed in a bath of molten metal to cause solid matter to move toward an upper surface of the bath. Each of the stirrer openings preferably extends at an angle with respect to the rotational axis of the impeller. In particular, the stirrer openings communicate with the cup-shaped interior. The stirrer openings are preferably forward pitched relative to a direction of rotation of the impeller. A bearing may be connected to the second end portion of the impeller.

Yet another embodiment of the present invention is directed to an impeller made of a non-metallic, heat resistant material, which is preferably used in a pump having a volute member in the chamber of the base of the pump. The impeller comprises a base having a generally circular base portion. A polygonal member, in preferably the form of a triangle, extends from the base portion. Stirrer openings in the polygonal member are configured and arranged to enable the impeller to cause solid matter in the molten metal to move toward an upper surface of the bath. Each of the stirrer openings preferably extends at an angle with respect to the longitudinal axis. In particular, each of the stirrer openings extends through the polygonal member and through the base portion. Stirrer openings may also be located in the base portion radially outwardly of the polygonal member. The stirrer openings are preferably forward pitched relative to a direction of rotation of the impeller. A bearing may be connected to the impeller base.

The present invention presents advantages compared to typical pumps and impellers for pumping molten metal. While sacrificing little or no pumping efficiency, the stirrer openings of the present invention provide forces that act upon molten metal below the pump base. This may stir up solid matter, especially at the bottom of the vessel, and is believed to cause the solid matter to rise toward the surface of the bath. Rotation of the stirrer openings is believed to enable particles, especially those suspended particles having approximately the specific gravity of the molten metal, to rise toward the surface of the bath. Therefore, when pumping molten metal according to the present invention, the step of spooning material from the bottom of the vessel may be reduced or eliminated. This results in less risk to workers, a savings due to reduction in the frequency of the spooning procedure, and assists in removing impurities from the molten metal.

A method of pumping molten metal with a non-metallic pump according to the present invention comprises the steps of submerging the base of the pump in a molten metal bath. The impeller is rotated on the end of the shaft in the impeller chamber of the base. Molten metal is moved through an entry opening of the pump base toward the rotating impeller in a generally longitudinal direction of the shaft and in a direction (e.g., radially) away from the impeller. The stirrer openings of the impeller are rotated to move solid matter in the molten metal toward an upper surface of the bath. The stirrer openings preferably generate suction forces on molten metal below the impeller. Alternatively, the stirrer openings generate pushing forces on molten metal below the impeller. The solid matter is then removed from the vessel.

Many additional features, advantages and a fuller understanding of the invention will be had from the accompanying drawings and the detailed description that follows.

DETAILED DESCRIPTION OF PREFERRED EMBODIMENT

Figure 1:
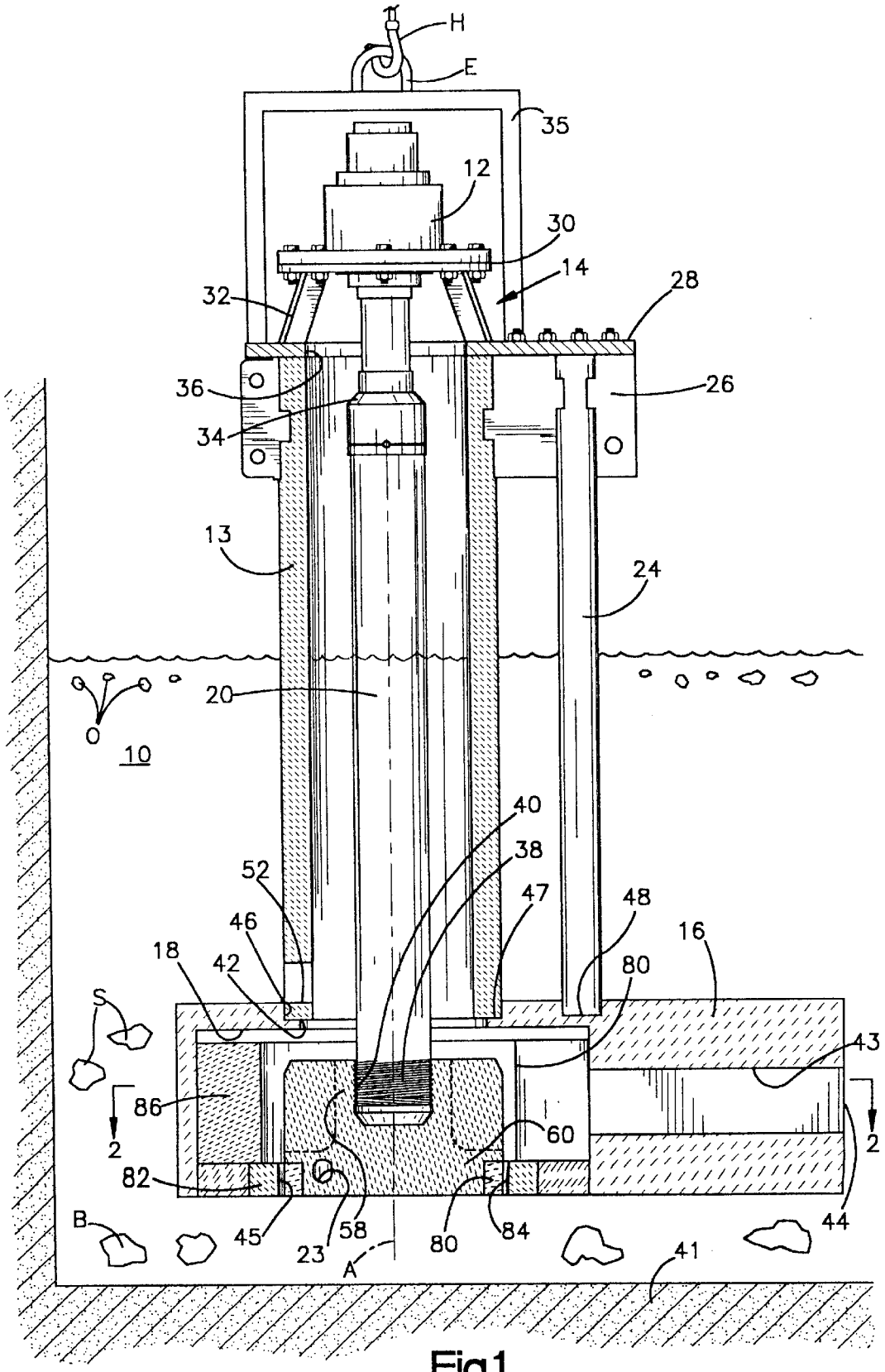
FIG. 1 is a vertical cross-sectional view of a pump constructed in accordance with the present invention.
Figure 2:
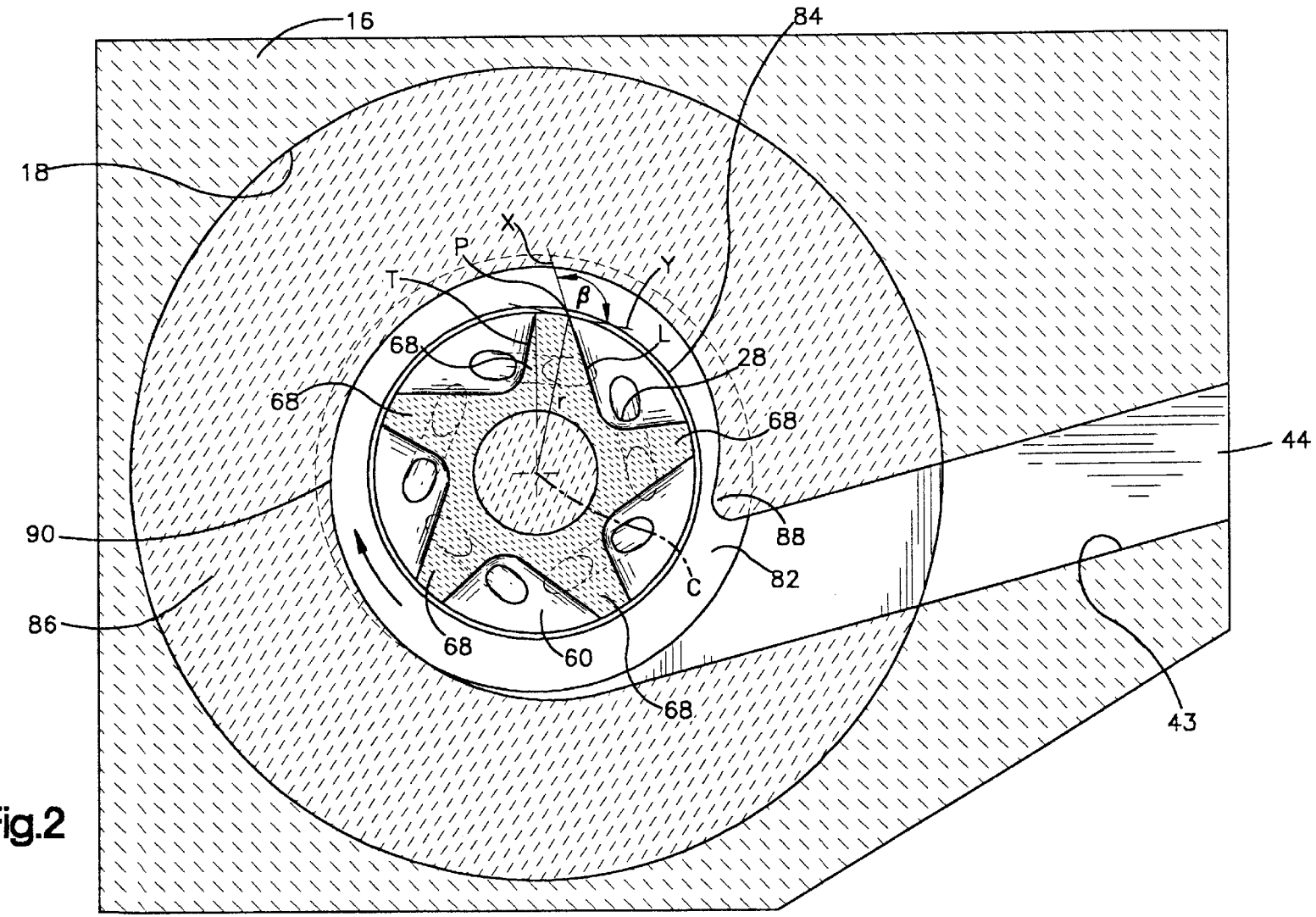
FIG. 2 is a cross-sectional view as seen approximately from a plane taken along the lines 2—2 of FIG. 1.

Referring now to the drawings and to FIGS. 1 and 2 in particular, the illustrated pump is a top feed discharge pump generally designated by reference numeral 10. The pump includes a motor 12 mounted to a motor mount 14. A base 16 has an impeller chamber 18 formed therein. A shaft 20 is connected to the motor 12 at one end. An impeller is connected to the other end of the shaft 20 and is rotatable in the impeller chamber 18. The impeller includes a plurality of stirrer openings 23 (one of which is shown in FIG. 1). These openings enable the impeller to exert forces on the molten metal that facilitate removal of solid matter in the molten metal. The molten metal is preferably aluminum or alloys thereof. The terms solid matter used herein refer to refractory material comprising refractory brick and metal oxide particles (e.g., aluminum oxide), as well as foreign objects.

A shaft sleeve 13 preferably surrounds the shaft 20. The shaft sleeve 13 and an optional support post 24 are disposed between the motor mount 14 and the base 16. The shaft sleeve 13 and the support post 24 have their lower ends fixed to the base 16. A quick release clamp 26 is carried by the motor mount 14. The quick release clamp is of the type described in U.S. patent application Ser. No. 08/385,357 to Thut, entitled "Pumps for Pumping Molten Metal," filed Feb. 8, 1995, which is incorporated herein by reference in its entirety. The clamp 26 releasably clamps upper end portions of the shaft sleeve 13 and the support post 24, for example. The motor mount may be pivotably mounted, as disclosed in U.S. patent application Ser. No. 08/771,606 to Thut, entitled "Pump for Pumping Molten Metal Having Cleaning and Repair Features," filed Dec. 20, 1996, which is incorporated herein by reference in its entirety.

It should be apparent that the invention is not limited to any particular pump construction, but rather may be used with any construction of transfer or circulation pump. More than one of the present impellers may be used, such as in a dual volute impeller pump of the type described by U.S. Pat. No. 4,786,230 to Thut.

The motor mount 14 comprises a flat mounting plate 28 including a motor support portion 30 supported by legs 32. A hanger 35, which may have an eye E, may be attached to the motor mount 14. A hook H on the end of a cable or the like is located in the eye and used to hoist the pump 10 into and out of the vessel or furnace. Various types of hangers are suitable for use in the present invention, for example, those disclosed in the publication "H.T.S. Pump Equation for the Eighties" by High Temperature Systems, Inc. The motor 12 is an air motor or the like, and is directly mounted onto the motor support portion 30.

The shaft 20 is connected to the motor 12 by a coupling assembly 34 which is preferably constructed in the manner shown in U.S. Pat. No. 5,622,481 to Thut, issued Apr. 22, 1997, entitled "Shaft Coupling For A Molten Metal Pump", which is incorporated herein by reference in its entirety. An opening 36 in the mounting plate 28 permits connecting the motor 12 to the shaft 20 with the coupling assembly 34. An apparatus may be used for sensing the rotational speed of the shaft, as disclosed in U.S. patent application Ser. No. 08/654,847 to Thut, entitled "Sensor Apparatus for Pumps for Pumping Molten Metal," which is incorporated herein by reference in its entirety.

The base 16 is spaced upward from the bottom of vessel 41 by about an inch, a few inches or more and has a molten metal inlet opening 42 leading to the impeller chamber 18 and a molten metal passage 43 leading to an outlet opening 44. An opening 45 is formed in a lower surface of the base concentric to the shaft 20 and receives the impeller. The present invention is most advantageous when used with the top feed type pump shown. An opening 46 surrounds the base inlet opening 42 and receives the shaft sleeve 13. A shoulder 47 is formed in the base 16 around the inlet opening 42, and supports the shaft sleeve 13. The shaft sleeve 13 is cemented in place on the shoulder 47. The shaft sleeve 13 contains multiple inlet openings 52 adjacent the base 16 (one of which is shown). The post 24 is cemented in place in an opening 48 in the base.

The impeller is attached to one end portion of the shaft 20 such as by engagement of exterior threads 38 formed on the shaft 20 with corresponding interior threads 40 formed in the impeller 22. However, any connection between the shaft 20 and the impeller, such as a keyway or pin arrangement, or the like, may be used.

Figure 3:
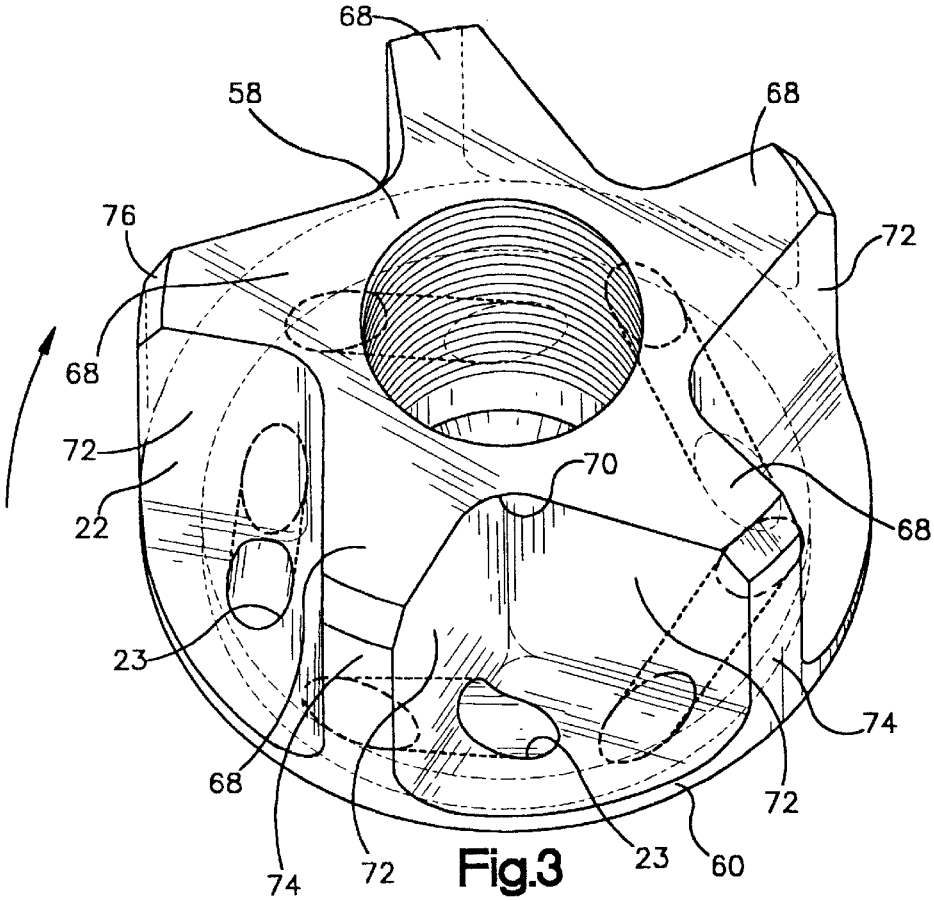
FIG. 3 is a perspective view of the impeller shown in FIG. 1.

In one embodiment shown in FIGS. 1–4, the impeller is a vaned impeller 22 which includes a base 60 having a base portion with a generally circular outer peripheral surface 62, an upper surface portion 64 and a lower surface portion 66. A generally cylindrical hub portion 58 is centered on and extends from the upper base portion 64 as best shown in FIGS. 1 and 3. The hub portion is preferred and provides the impeller with desired strength. Preferably five vanes 68 extend outwardly from a center point C of the impeller base 60 (FIG. 2) and, preferably, from the hub portion 58, to the outer peripheral surface 62 of the base 60. The vanes 68 also extend from the upper base surface 64 generally in a direction of elongation of the shaft 20 along axis A. The hub portion preferably interconnects the vanes 68.

As best shown in FIGS. 2 and 3, the vanes 68 preferably extend substantially tangentially from the hub portion 58. The vanes 68 preferably are generally straight rather than curved. That is, a straight line can be drawn completely within a body of a vane for its entire length from the central opening to the outer peripheral surface 62 of the impeller base. The vanes may be connected to one another by curved surfaces 70 of the hub portion (FIG. 3). Each vane 68 has two sidewalls 72 that extend in a second direction from the hub portion 58 to a vane end portion 74 and in a first direction along the longitudinal axis A of the shaft (corresponding to the rotational axis of the impeller). A side surface of each vane is spaced apart from a side surface of an adjacent vane entirely along the first and second directions.

The impeller 22 may include tapered portions 76 each at an upper portion of the vane end 74, which are used to fit the impeller 22 into the impeller chamber 18. The tapered portions 76 may be configured differently or omitted, depending on the configuration of the impeller chamber 18 or of pump components therein. The vanes 68 each have a root portion R adjacent the base portion 60 and a tip portion remote from the base portion near surface 58. The root portion may be wider than the thickness of the vane as shown in FIG. 4.

The stirrer openings 23 are formed in the impeller base 60 and preferably extend between the upper and lower surfaces 64, 66 of the impeller base. In preferred form, the stirrer openings extend at an angle e with respect to a line L that is perpendicular to the upper surface 64 of the impeller base and parallel to the rotational axis A of the impeller. The angle θ ranges from 0° (i.e., parallel to the line L and perpendicular to the upper base surface 64) to any angle less than 90° at which at least a portion of the opening will protrude from the lower base surface 66. For example, the angle θ shown in FIG. 4 is approximately 30°. The number of stirrer openings in the base is preferably 5, one opening being located between adjacent vanes. However, it will be appreciated by those skilled in the art in view of this disclosure that the number and location of stirrer openings in the base may vary.

The impeller shown in FIGS. 2 and 3 is rotated in a clockwise direction when viewed from above, as shown by the arrow. Referring to FIG. 2, each vane has a leading side L and a trailing side T with respect to the direction of rotation. That is, when the impeller is rotated clockwise the leading side L will pass a given point outside the impeller before the trailing side T. A line X extends outwardly along the leading side L. A circle has a radius r corresponding to the distance from the centerpoint C to an outermost point P on the leading side L of the vane. Line Y is drawn tangent to the point P on the circle. When the vanes extend all the way to the circular outer periphery 62 of the impeller base 60, the circle is the same as the outer periphery 64. However, the vanes need not extend all the way to the periphery of the base 60. The angle β between the line X and the line Y is obtuse. For example, as shown in FIG. 2, angle β is approximately 120°. The leading edge L of the vanes have a "reverse bend" to them with respect to the direction of rotation, a "forward bend" being when the angle β is acute.

Figure 4:
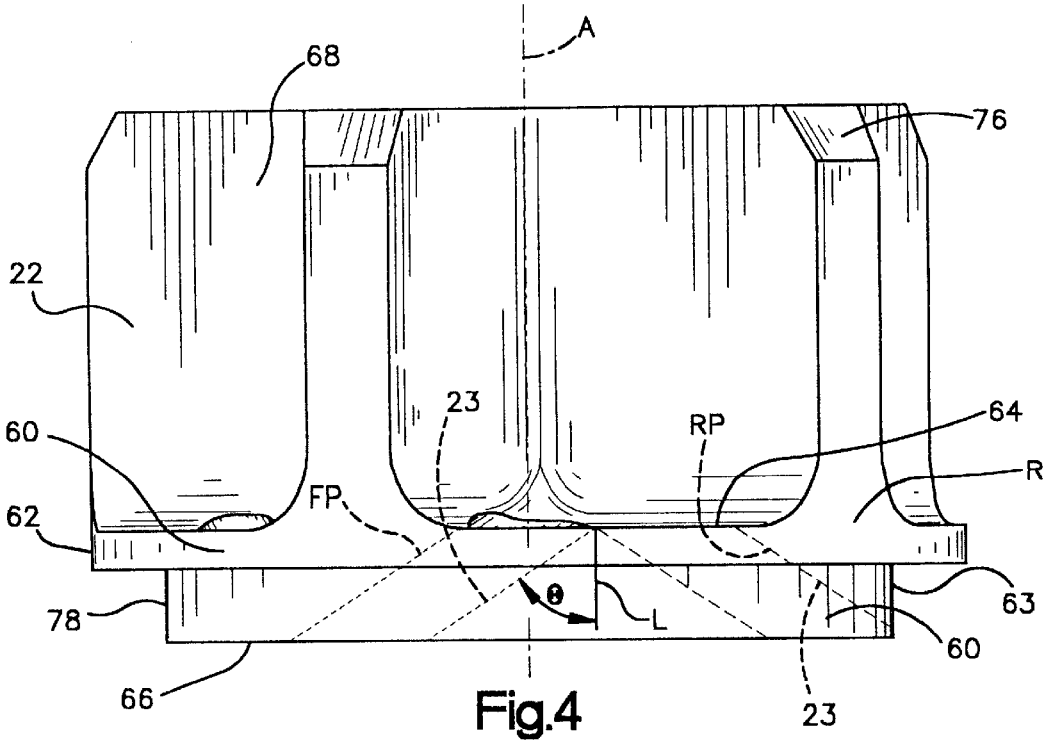
FIG. 4 is a side elevational view of the impeller shown in FIG. 1.

As shown in FIGS. 2–4, the stirrer openings 23 are forward extending. From the upper base surface 64 to the lower base surface 66, the openings have a forward pitch FP with respect to the direction of rotation. For example, with respect to a point of reference located outside the impeller 22, as the impeller is rotated clockwise, the portion of the opening 23 that communicates with the lower base surface 66 will pass the reference point before the portion of the same opening that communicates with the upper surface 64. The pitch of the stirrer openings 23 is an important feature of the present invention. By using openings having a forward pitch, the impeller imparts suction forces on the molten metal below the impeller and is believed to pull molten metal through the openings into the pump base. This is believed to stir up solid matter in the molten metal and cause the solid matter, especially on or near the bottom of the vessel, to move toward the upper surface of the bath where it can be removed by skimming.

The forward pitch and attendant suction forces are preferred. However, the openings may also be designed to have a rearward pitch RP (FIG. 4) with respect to the clockwise direction of rotation. This enables the impeller to exert pushing forces on molten metal below the impeller, which may also stir up solid matter on the bottom of the vessel.

The impeller base 60 includes an annular groove 78, which receives an impeller bearing 80. The bearing 80 is secured in the groove 78 such as by cementing or the like. The impeller bearing 80 is made of high strength refractory material, for example, a ceramic material such as silicon carbide or silicon nitride. The impellers of the present invention are preferably machined from graphite and are of one-piece construction. If the impeller is comprised of a high strength refractory material, for example, a ceramic material such as silicon carbide or silicon nitride, the impeller bearing 80 may be omitted.

The annular impeller bearing 80 is circumscribed by an annular base bearing 82 disposed at a lower portion of the pump base 16. The bearings 80 and 82 protect the impeller from striking the base 16. There is an annular gap 84 between the base bearing 82 and the impeller bearing 80 to allow for rotation of the impeller. The impeller bearing 80 and the base bearing 82 are employed to prolong the life of the impeller, since during vibration the impeller will not strike the base bearing 82 or the pump base, but rather its impeller bearing 80 will strike the base bearing 82. The impeller optionally includes an upper bearing (not shown) and the pump 10 optionally includes a corresponding bearing surrounding the upper impeller bearing.

The shaft 20 may have a refractory sleeve formed around it (not shown), which protects the shaft from oxidation and erosion by the molten metal. The shaft 20 may include a shaft bearing which engages a corresponding bearing in the shaft sleeve 13 or the base 16. The shaft 20, shaft sleeve 13, impeller, impeller bearing 80, and base bearing 82 are composed of refractory material such as graphite or ceramic materials, to resist oxidation and erosion when these parts are subjected to the molten metal.

A volute member 86 is optionally used in the impeller chamber 18. The volute member 86 preferably has a spiral shape surrounding the impeller, as shown in FIG. 2. Due to the spiral shape of the volute member 86, a portion 88 of the volute member is near the impeller, and a portion 90 of the volute member is remote from the impeller. Using a spiral volute such as the volute member 86 may produce advantageous molten metal flow properties as is known in the art.

While not wanting to be bound by theory, there are believed to be advantageous mechanisms behind the use of five vanes in the impeller 22 of the invention, as described in U.S. Pat. No. 5,597,289 to Thut, entitled "Dynamically Balanced Pump Impeller," which is incorporated herein by reference in its entirety. The present impeller 22 when using five vanes advantageously overcomes all of the vibration problems of prior art cylindrical volute impellers. Using five vanes provides the impeller 22 with good displacement without the repeated impact problems that occur with two and four bladed cylindrical volute impellers. The five vaned impeller is dynamically balanced and impact on the impeller bearing 80 and on any shaft bearing occur at different radial locations on the peripheries of these bearings upon each oscillation of the impeller on the end of the shaft. This prolongs the useful life of the impeller. Although the use of five vanes is preferred, using other numbers of vanes of preferably equal circumferential spacing in conjunction with the stirrer openings in the impeller 22, may also produce the advantageous stirring action of the present invention. For example, the impeller 22 may have four vanes, although it is believed such an impeller will have a lesser life than the five vaned impeller.

Figure 5:
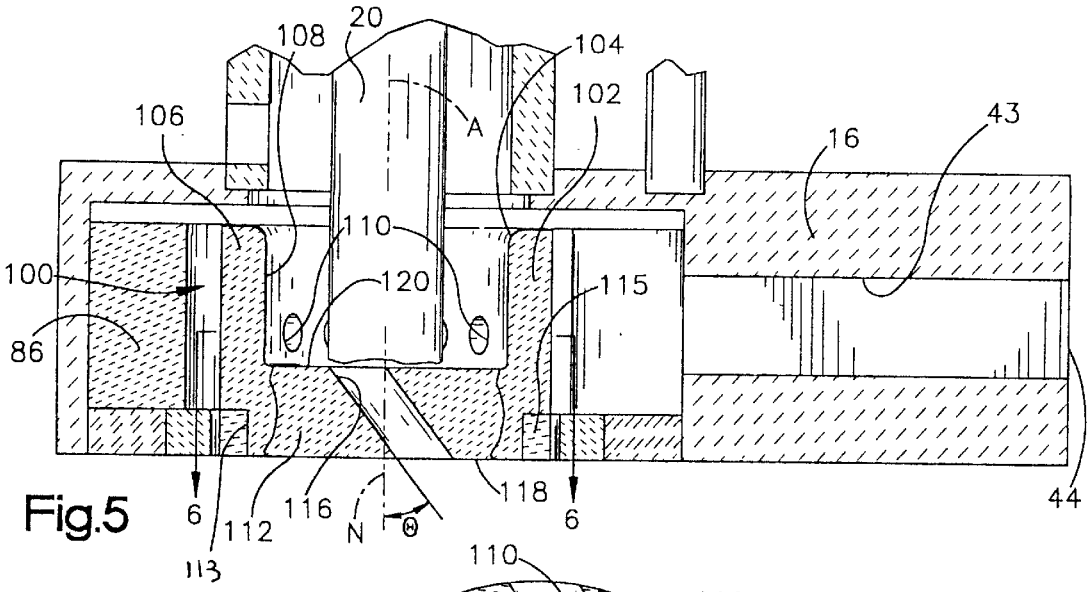
FIG. 5 is a vertical cross-sectional view of a pump employing another impeller constructed in accordance with the present invention.
Figure 6:
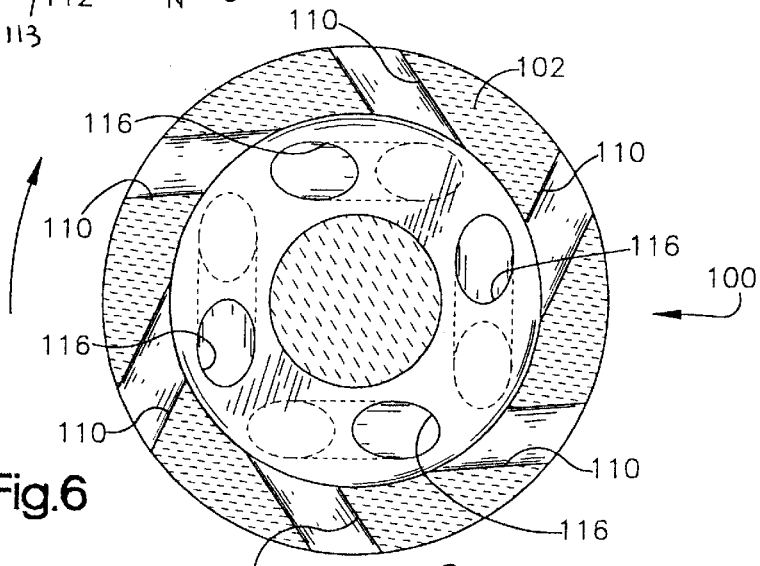
FIG. 6 is a cross-sectional view of the impeller as seen approximately from a plane taken along the lines 6—6 in FIG. 5.

Referring to FIGS. 5 and 6, another embodiment of an impeller in a pump constructed in accordance with the present invention is designated generally at 100. This type of impeller is referred to as a squirrel cage impeller. The impeller loo is suitable for use with all of the pump components described above and like numerals are used to designate like parts of the pump herein. The impeller 100 has a body 102 made of a non-metallic, heat resistant material comprising an opening 104 at a first upper end portion 106 leading to a central cup-shaped interior 108. The body includes main openings 110 that extend outwardly from the cup-shaped interior. The impeller shown in FIGS. 5 and 6 is rotated in a clockwise direction when viewed from above, as shown by the arrow in FIG. 6. The main openings 110 have a reverse bend with respect to the direction of rotation. A second end portion 112 is spaced from the first end portion along the axis of rotation A of the impeller. The impeller has a recessed portion 113 for receiving a bearing ring 115. When using the squirrel cage impeller 100, a filter device may be used to prevent material from entering the impeller chamber and damaging the impeller.

Stirrer openings 116 are configured and arranged to enable the impeller when immersed in a bath of molten metal to cause solid matter to move toward an upper surface of the bath. Each of the stirrer openings 116 preferably extends at an angle e with respect to a normal N to a face 118 of the second end portion, the normal N being parallel to the rotational axis A of the impeller. The angle θ preferably ranges from 0° (i.e., parallel to the line N and perpendicular to the face 118) to any angle less than 90° at which at least a portion of the opening will protrude from the lower face 118. The angle θ shown in FIG. 5 is approximately 30°. At least a portion of each stirrer opening 116 preferably communicates with both an interior surface 120 of the cup-shaped interior and with the face 118. The number of stirrer openings may be 4, for example. However, it will be appreciated by those skilled in the art in view of this disclosure that the number and location of the stirrer openings in the second end portion may vary.

As shown in FIGS. 5 and 6, the stirrer openings 116 are forward extending. The openings have a forward pitch with respect to the direction of rotation from the lower surface 120 of the cup-shaped interior to the lower face 118. Due to the forward pitch of the openings 110, the impeller imparts suction forces on the molten metal below the impeller and is believed to pull molten metal through the openings into the pump base. This is believed to stir up solid matter in the molten metal and cause the solid matter, especially on or near the bottom of the vessel, to move toward the upper surface of the bath where it can be removed by skimming.

Although the forward pitch and attendant suction forces are preferred, the stirrer openings 110 may also be designed to have a rearward pitch with respect to the clockwise direction of rotation, in the manner shown in FIG. 4. This enables the impeller to exert pushing forces on molten metal below the impeller, which may also stir the solid matter.

Figure 7:
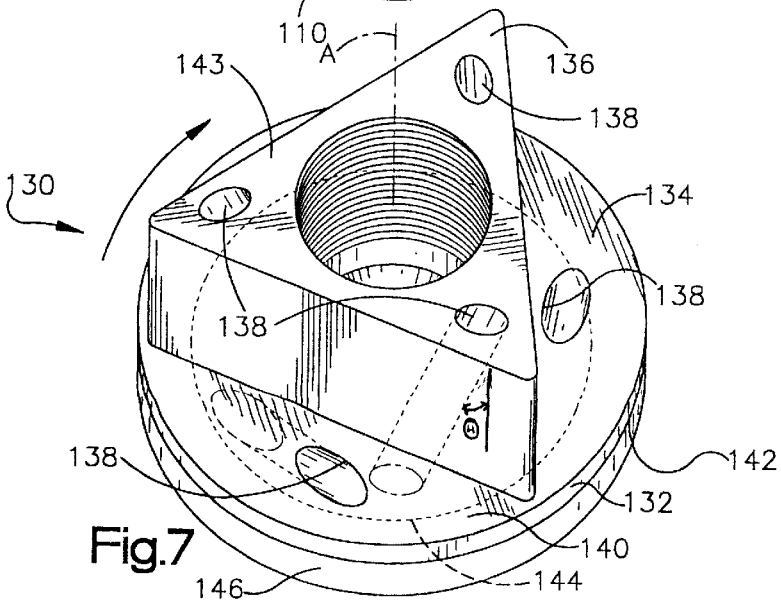
FIG. 7 is a perspective view of another impeller constructed in accordance with the present invention.

Referring to FIG. 7, another embodiment of the present invention is shown. An impeller shown generally at 130 comprises a base 132 having a generally circular base portion 134. The impeller 130 is suitable for use with all of the pump components described above. A polygonal member 136 is located on the base. Stirrer openings 138 are disposed in the polygonal member 136 and, in addition, optionally in the base portion 134 radially outside of the polygonal member. The stirrer openings are configured and arranged to enable the impeller when immersed in a bath of molten metal to cause solid matter to move toward an upper surface of the bath. Each of the stirrer openings 138 preferably extends at an angle with respect to a normal to a face of the base portion. The stirrer openings 138 each extend at an angle θ with respect to a normal to the surface 134 or the surface 143, the normal N being parallel to the rotational axis A of the impeller. The angle θ preferably ranges from 0° (i.e., parallel to the line N and perpendicular to the surface 134 or the surface 143) to any angle less than 90° at which at least a portion of the opening will protrude from the lower surface 142. For example, the angle of the stirrer openings 138 located in the base radially outward of the polygonal member, as opposed to those originating at upper surface 143, is approximately 30°. The impeller 130 is rotated in a clockwise direction when viewed from above, as shown by the arrow in FIG. 7. The base 132 preferably has a recess 144 that receives an annular bearing 146, similar to the recess and bearing shown in FIG. 4.

As shown in FIG. 7, the stirrer openings 138 are forward extending. The stirrer openings extend from an upper base surface 140 to a lower base surface 142, and from an upper polygonal member surface 143 to the lower base surface 142, respectively, along which extension the stirrer openings have a forward pitch with respect to the direction of rotation. Due to the forward pitch of the openings 138, the impeller has a suction effect on the molten metal below the impeller and is believed to pull molten metal through the openings into the pump base. This is believed to stir up solid matter in the molten metal and cause the solid matter, especially on or near the bottom of the vessel, to move toward the upper surface of the bath where it can be removed by skimming.

Although the forward pitch and attendant pulling forces are preferred, the openings 138 may also be designed to have a rearward pitch with respect to the clockwise direction of rotation, in the manner shown in FIG. 4. This enables the impeller to exert a pushing force on molten metal below the impeller, which may also stir the solid matter.

Any suitable number of stirrer openings may be used. For example, the impeller may have three stirrer openings 138 in the polygonal member, one at each corner of the polygonal member 136. In addition, the impeller 130 may include, for example, three stirrer openings 138 in the base portion 134. In this and in the other impellers of the invention, the number, size and arrangement of the stirrer openings should be selected to provide stirring action while preferably not substantially reducing pumping efficiency and/or substantially adversely affecting the balance of the impeller.

During the operation of the pump using the impellers of the present invention, the hook H on the end of the cable is fastened in the eye E of the hanger. A device such as a winch lowers the pump 10, which is suspended on the cable, into a molten metal bath above the bottom of the vessel. The pump may be secured in place above the bath in a manner known to those skilled in the art. The motor 12 is activated to rotate the shaft 20 via the coupling assembly 34. Rotation of the shaft 20 rotates the impeller 22, 100, 130 and centrifugal forces created thereby cause molten metal to be drawn into the top of the pump 10. The motor may drive the shaft at between 300 to 400 rpm, for example. The molten metal enters the multiple inlet openings 52 of the shaft sleeve 13, passes through the base inlet opening 42, and then passes into the impeller chamber 18. The vanes of the impeller 22, main openings in the cup-shaped interior of the impeller 100 and polygonal member of the impeller 130 move the molten metal toward the impeller generally along the axis A and then away from the impeller generally either radially or tangentially through the passageway 43 of the base 16. The molten metal leaves the base through the outlet opening 44. The impeller is preferably designed with stirrer openings 23, 116, 138 that are forward pitched. The pump may be operated for cleaning purposes as disclosed in the 08/771,606 application.

Referring to FIG. 1, refractory material (e.g., aluminum oxides) that have a specific gravity less than the metal are designated O and are located near the surface. Suspended refractory materials having a specific gravity approximating that of the metal are designated S. Refractory materials having a specific gravity greater than that of the metal such as pieces of bricks are designated B, and are located near the bottom of the vessel. As the impeller is rotated clockwise, suction (or pushing) forces are created, and are believed to stir up solid matter in the molten metal bath, especially on the bottom of the vessel. Suction forces are believed to be more effective than pushing forces in generating the stirring action. When forward pitched stirrer openings are used, some molten metal is believed to be drawn by suction through the stirrer openings of the impeller and into the base. The suspended particles S and lower material such as the brick pieces B may move toward the upper surface of the bath. Workers remove these impurities using the elongated steel paddle with the perforated spoon end portion. Advantageously, in accordance with the invention the step of spooning material from the bottom of the vessel may be reduced in frequency or duration, or eliminated altogether. It is believed that most of the refractory material may be removed by spooning material from on or near the surface in accordance with the present invention.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. In a non-metallic pump for pumping molten metal including a motor, a shaft having one end connected to the motor and extending along a longitudinal axis, an impeller connected to the other end of the shaft, a base having a chamber in which the impeller is rotatable, an inlet opening through which molten metal can enter the base, a base opening in one of an upper and lower portion of said base and an outlet opening through which molten metal can leave the base, and structure for removably inserting the base into a bath of molten metal, the improvement wherein the impeller is made of a non-rnetallic, heat resistant material, and comprises a generally circular base portion at one end of the impeller having surfaces that extend generally transverse to the longitudinal axis, wherein said base portion is disposed so as to obstruct said base opening, an end face spaced apart from said one end along the longitudinal axis, vanes extending outwardly from said base portion and along said longitudinal axis between said end face and said base portion, and impeller openings circumferentially spaced apart from each other between the surfaces of said base portion.

2. The improvement of claim 1 wherein said impeller comprises a hub portion located centrally on said impeller base portion, and said vanes extend outwardly from the hub portion.

3. The improvement of claim 2 wherein said vanes extend tangentially from the hub portion.

4. The improvement of claim 1 wherein said impeller base portion comprises a ceramic material.

5. The improvement of claim 1 wherein said impeller openings each extend at an angle in said impeller base portion with respect to said longitudinal axis of the shaft.

6. The improvement of claim 1 wherein each of said vanes has two side surfaces extending generally along said longitudinal axis and from a central location of said impeller base portion in an outward direction transverse to said longitudinal axis, a side surface of each of said vanes being spaced apart from a side surface of an adjacent vane entirely along said longitudinal axis and said outward direction.

7. The improvement of claim 1 wherein said impeller openings are forward pitched relative to a direction of rotation of said impeller.

8. The improvement of claim 1 wherein said impeller has five vanes constructed and arranged to dynamically balance said impeller.

9. The improvement of claim 1 wherein said impeller openings are configured and arranged to direct molten metal through said impeller openings and into said pump base.

10. In a non-metallic pump for pumping molten metal including a motor, a shaft having one end connected to the motor and extending along a longitudinal axis, an impeller connected to the other end of the shaft, a base having a chamber in which the impeller is rotatable, an inlet opening through which molten metal can enter the base, a base opening in one of an upper and lower portion of said base and an outlet opening through which molten metal can leave the base, and structure for removably inserting the base into a bath of molten metal, the improvement wherein the impeller is made of a non-metallic, heat resistant material and comprises an inlet opening at one end portion leading to a central cup-shaped interior, said impeller inlet opening being located adjacent said base inlet opening, main outlet openings extending outwardly from the cup-shaped interior generally transverse to said longitudinal axis, a generally circular base portion spaced from said one end portion along said longitudinal axis, wherein said base portion extends between an interior face that forms a portion of said cup-shaped interior and an exterior face and said base portion is disposed so as to obstruct said base opening, said interior face and said exterior face extending generally transverse to said longitudinal axis, and impeller openings in said base portion that extend from said interior face.

11. The improvement of claim 10 wherein said impeller openings communicate with the cup-shaped interior and extend between said interior face and said exterior face.

12. The improvement of claim 10 wherein said impeller base portion comprises ceramic material.

13. The improvement of claim 10 wherein said impeller openings each extend at an angle in said impeller base portion with respect to said longitudinal axis.

14. The improvement of claim 10 wherein said impeller openings are forward pitched relative to a direction of rotation of said impeller.

15. The improvement of claim 10 wherein said impeller openings are configured and arranged to direct molten metal through said impeller openings and into said pump base.

16. In a non-metallic pump for pumping molten metal including a motor, a shaft having one end adjacent the motor and extending along a longitudinal axis, an impeller connected to the other end of the shaft, a base having a chamber in which the impeller is rotatable, an Inlet opening through which molten metal can enter the base, a base opening in one of an upper and lower portion of the base and an outlet opening through which molten metal can leave the base, and structure for removably inserting the base into a bath of molten metal, the improvement wherein the impeller is made of a non-metallic, heat resistant material, and comprises a generally circular base portion having faces that extend generally transverse to said longitudinal axis, said base portion being disposed so as to obstruct said base opening, a triangular shaped polygonal member extending from the base portion, and impeller openings in at least one of said impeller base portion and said polygonal member.

17. The improvement of claim 16 wherein said impeller base portion comprises ceramic material.

18. The improvement of claim 16 wherein said impeller openings each extend at an angle with respect to said longitudinal axis.

19. The improvement of claim 16 wherein said polygonal member is in the shape of a triangle.

20. The improvement of claim 16 wherein said impeller openings are forward pitched relative to a direction of rotation of said impeller.

21. The improvement of claim 16 further comprising impeller openings located in said base portion radially outwardly of said polygonal member.

22. The improvement of claim 16 comprising a volute member in the chamber of said pump base.

23. The improvement of claim 16 wherein said impeller openings are configured and arranged to direct molten metal through said impeller openings and into said pump base.

24. In a non-metallic pump for pumping molten metal including a motor, a shaft having one end adjacent the motor and extending along a longitudinal axis, an impeller connected to the other end of the shaft, a base having a chamber in which the impeller is rotatable, an inlet opening through which molten metal can enter the base and an outlet opening through which molten metal can leave the base, and structure for removably inserting the base into a bath of molten metal, the improvement wherein the impeller is made of a non-metallic, heat resistant material, and comprises a generally circular base portion, a polygonal member extending from the base portion, and impeller openings that extend through said polygonal member and through said impeller base portion.

25. An impeller for pumping molten metal, said impeller being made of a non-metallic, heat resistant material and comprising a generally circular base portion at one end of the impeller having surfaces that extend generally transverse to a rotational axis of the impeller, an end face spaced apart from said one end along the rotational axis, vanes extending outwardly from said base portion and along said rotational axis between said end face and said base portion, and impeller openings circumferentially spaced apart from each other between the surfaces of said base portion, wherein each of said impeller openings extends at an angle with respect to said rotational axis.

26. The impeller of claim 25 further comprising a central hub portion from which said vanes extend transverse to the rotational axis.

27. The impeller of claim 26 wherein said vanes extend tangentially from said hub portion.

28. The impeller of claim 25 wherein said impeller base portion comprises ceramic material.

29. The impeller of claim 25 wherein each of said vanes has two side surfaces extending generally along said rotational axis and from a central location of said impeller base portion in an outward direction transverse to said rotational axis, a side surface of each of the vanes being spaced apart from a side surface of an adjacent vane entirely along said rotational axis and said outward direction.

30. The impeller of claim 25 wherein said impeller openings are forward pitched relative to a direction of rotation of said impeller.

31. The impeller of claim 25 wherein said impeller has five vanes constructed and arranged to dynamically balance said impeller.

32. An impeller for pumping molten metal, said impeller being made of a non-metallic, heat resistant material and comprising an inlet opening at one and portion leading to a central cup-shaped interior, main outlet openings extending outwardly from the cup-shaped interior generally transverse to an axis of rotation of the impeller, a generally circular base portion spaced from said one end portion along said axis of rotation of said impeller, said base portion extending between an interior face that forms a portion of said cup-shaped interior and an exterior face, said interior face and said exterior face extending generally transverse to said axis of rotation, and impeller openings in said base portion that extend from said interior face.

33. The impeller of claim 32 wherein said impeller openings communicate with the cup-shaped interior and extend between said interior face and said exterior face.

34. The impeller of claim 32 wherein said impeller base portion comprises ceramic material.

35. The impeller of claim 32 wherein said impeller openings are forward pitched relative to a direction of rotation of said impeller.

36. An impeller for pumping molten metal, said impeller being made of a non-metallic, heat resistant material, comprising a generally circular base portion having faces that extend generally transverse to an axis of rotation of the impeller, a triangular shaped polygonal member extending from the base portion, and impeller openings in at least one of said base portion and said polygonal member.

37. The impeller of claim 36 wherein said impeller base portion comprises ceramic material.

38. The impeller of claim 36 wherein said polygonal member is in the shape of a triangle.

39. The impeller of claim 36 wherein said impeller openings are forward pitched relative to a direction of rotation of said impeller.

40. The improvement of claim 36 further comprising impeller openings located in said base portion radially outwardly of said polygonal member.

41. An impeller for pumping molten metal, said impeller being made of a non-metallic, heat resistant material, comprising a generally circular base portion, a polygonal member extending from the base portion, and impeller openings that extend through said polygonal member and through said impeller base portion.

42. An impeller for pumping molten metal, said impeller being made of a non-metallic, heat resistant material, comprising means for moving molten metal in a direction generally along an axis of rotation of said impeller and in a direction generally transverse to said rotational axis, a generally circular base portion disposed at an end of the impeller having surfaces that extend in the transverse direction along a substantial radial portion of said impeller and are exposed to said molten metal along said radial portion, and impeller openings extending between the surfaces of said impeller base portion each extending at an angle with respect to said rotational axis.

43. The impeller of claim 42 wherein said impeller openings are forward pitched relative to a direction of rotation of said impeller.

44. The impeller of claim 42 wherein said means for moving molten metal comprises five vanes constructed and arranged to dynamically balance said impeller and extending from said base portion.

45. The impeller of claim 42 wherein said means for moving molten metal comprises an opening leading to a central cup-shaped interior of said impeller and main openings extending outwardly from the cup-shaped interior, said impeller openings being In communication with said cup-shaped interior.

46. The impeller of claim 42 wherein said means for moving molten metal comprises a generally circular base portion which comprises ceramic material.

47. A method of pumping molten metal with a non-metallic pump comprising the steps of submerging a base of the pump in a bath of molten metal;

rotating an impeller on the end of a shaft in a chamber of the pump base;

moving molten metal, as a result of rotation of said impeller, through an inlet opening of the pump base toward the impeller in a generally longitudinal direction of the shaft;

moving molten metal as a result of rotation of said impeller, away from the impeller In a direction generally transverse to the longitudinal direction and through an outlet opening of the pump base;

rotating impeller openings disposed in a generally circular base portion at one end of the impeller, wherein said base portion includes surfaces that extend generally transverse to said rotational axis and said base portion is disposed so as to rotate in an opening that is located in one of an upper and lower portion of said pump base; and moving solid matter in the molten metal toward an upper surface of the bath by the rotation of said impeller openings.

48. The method of claim 47 wherein said solid matter comprises aluminum oxide.

49. The method of claim 47 wherein said impeller openings generate suction forces on molten metal outside the pump base.

50. The method of claim 47 wherein said impeller openings generate pushing forces on molten metal outside the pump base.

51. The method of claim 47 wherein said impeller opening are rotated in an opening in a lower surface of the pump base.

* * * * *